US011840906B2

(12) United States Patent
Gettis

(10) Patent No.: US 11,840,906 B2
(45) **Date of Patent: *Dec. 12, 2023**

(54) DOWNHOLE PRESSURE WAVE GENERATING DEVICE

(71) Applicant: Optimum Petroleum Services Inc., Calgary (CA)

(72) Inventor: James G Gettis, Calgary (CA)

(73) Assignee: OPTIMUM PETROLEUM SERVICES INC., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/822,944

(22) Filed: Aug. 29, 2022

(65) Prior Publication Data

US 2022/0412191 A1 Dec. 29, 2022

Related U.S. Application Data

(63) Continuation of application No. 17/010,446, filed on Sep. 2, 2020, now Pat. No. 11,459,856.
(Continued)

(51) Int. Cl.
*E21B 37/00* (2006.01)
*E21B 28/00* (2006.01)
(Continued)

(52) U.S. Cl.
CPC ..... *E21B 37/00* (2013.01); *E21B 28/00* (2013.01); *E21B 34/066* (2013.01); *E21B 37/08* (2013.01);
(Continued)

(58) Field of Classification Search
CPC ..... E21B 37/00; E21B 28/00; E21B 34/066; E21B 37/08; E21B 43/003; E21B 1/00;
(Continued)

(56) References Cited

U.S. PATENT DOCUMENTS 2,055,515 A * 9/1936 Yarbrough ..... E21B 37/08 166/186
2,915,122 A 12/1959 Hulse
(Continued)

FOREIGN PATENT DOCUMENTS

CA 2098000 12/1994
WO 2008054256 5/2008
(Continued)

OTHER PUBLICATIONS

Maurice B. Dusseault et al., A Dynamic Pulsing Workover Technique for Wells, 1999, pp. 1-10, PE-TECH inc., Lloydminister, Alberta, T9V 2S1.
(Continued)

*Primary Examiner* — Jonathan Malikasim
(74) *Attorney, Agent, or Firm* — Heslin Rothenberg Farley & Mesiti P.C.; Victor A. Cardona, Esq.

(57) ABSTRACT

A device for generating pressure waves in a well or a wellbore. The device includes a housing containing an impact-generating mechanism for generating the pressure waves and a connector for connecting the housing to a conveyor for transporting the device to any desired location within the well or the wellbore. The device may be used for a number of downhole applications such as cleaning perforations, fracturing processes, vibration of a casing to prevent fluid flow in a cemented annulus, hydraulic jar operations for freeing stuck downhole objects, generating data to optimize pumping parameters and as an enhancement to percussion drilling techniques.

19 Claims, 5 Drawing Sheets

Related U.S. Application Data

(60) Provisional application No. 62/896,802, filed on Sep. 6, 2019.

(51) Int. Cl.

| | |
|---|---|
| ***E21B 43/00*** | (2006.01) |
| ***E21B 34/06*** | (2006.01) |
| ***E21B 37/08*** | (2006.01) |
| ***E21B 1/00*** | (2006.01) |
| ***E21B 31/113*** | (2006.01) |
| ***E21B 43/26*** | (2006.01) |
| ***E21B 1/38*** | (2006.01) |
| ***E21B 31/107*** | (2006.01) |

(52) U.S. Cl.
CPC ..... *E21B 43/003* (2013.01); *E21B 1/00* (2013.01); *E21B 1/38* (2020.05); *E21B 31/107* (2013.01); *E21B 31/113* (2013.01); *E21B 43/26* (2013.01)

(58) Field of Classification Search
CPC ..... E21B 1/38; E21B 31/107; E21B 31/113; E21B 43/26; E21B 4/14
See application file for complete search history.

(56) References Cited

U.S. PATENT DOCUMENTS

| | | | | | |
|---|---|---|---|---|---|
| 3,137,483 | A * | 6/1964 | Zinkiewicz | E21B 4/145 | 180/7.1 |
| 3,361,220 | A * | 1/1968 | Brown | E21B 31/113 | 173/78 |
| 3,403,739 | A * | 10/1968 | Brown | E21B 4/14 | 173/136 |
| 3,410,353 | A * | 11/1968 | Martini | E21B 4/14 | 173/73 |
| 3,589,442 | A * | 6/1971 | Kilgore | E21B 43/25 | 166/299 |
| 4,210,214 | A * | 7/1980 | Blanton | E21B 31/113 | 175/297 |
| 4,407,365 | A | 10/1983 | Cooke, Jr. | | |
| 4,518,041 | A | 5/1985 | Zublin | | |
| 5,060,725 | A | 10/1991 | Buell | | |
| 5,579,845 | A * | 12/1996 | Jansen | E21B 31/005 | 166/305.1 |
| 5,836,389 | A | 11/1998 | Wagner et al. | | |
| 5,836,393 | A | 11/1998 | Johnson | | |
| 6,668,948 | B2 | 12/2003 | Buckman, Sr. et al. | | |
| 7,114,576 | B2 * | 10/2006 | Keskiniva | E21B 44/00 | 173/112 |
| 7,669,651 | B1 | 3/2010 | Carstensen | | |
| 8,113,278 | B2 | 2/2012 | Delacroix et al. | | |
| 9,863,225 | B2 | 1/2018 | Paulsen | | |
| 10,001,573 | B2 * | 6/2018 | Kusko | G01V 1/137 | |
| 10,107,081 | B2 | 10/2018 | Paulsen | | |
| 11,459,856 | B2 * | 10/2022 | Gettis | E21B 34/066 | |
| 2017/0074084 | A1 * | 3/2017 | Gettis | E21B 43/38 | |

FOREIGN PATENT DOCUMENTS

| | | |
|---|---|---|
| WO | 2016167666 | 10/2016 |
| WO | 2016209084 | 12/2016 |

OTHER PUBLICATIONS

Maurice Dusseault, Downhole Technology, 2008, pp. 1-2, vol. 3 Issue 2, Alberta Oil.
JTJ (Tim) Spanos et al., Pressure Pulsing at the Reservoir Scale: A New IOR Approach, 1999, pp. 1-13, Calgary, Alberta.
Office Action dated Jan. 5, 2022 (U.S. Appl. No. 17/010,446), 19 pp.

* cited by examiner

DOWNHOLE PRESSURE WAVE GENERATING DEVICE

CROSS-REFERENCE TO RELATED APPLICATIONS

This application is a continuation of U.S. patent application Ser. No. 17/010,446 filed Sep. 2, 2020, which claims priority from U.S. Provisional Application Ser. No. 62/896,802 filed on Sep. 6, 2019, the entire disclosure of which is incorporated herein by reference.

FIELD

The invention relates to recovery of hydrocarbons from hydrocarbon-bearing formations and more particularly to tools and processes using pressure waves for downhole applications with the general objective of increasing production of hydrocarbons.

BACKGROUND

When a well for extracting a natural resource such as natural gas or petroleum is being completed, the well casing and the cement on the exterior of the wellbore must be perforated at production depth to allow movement of fluid into and/or out of the wellbore. Perforation is done after the well is fully cemented and the cement has dried. The perforations are used to provide a pathway for fluid to flow between the formation and the well to allow production of hydrocarbons, for example. Hydrocarbons are generally produced from a reservoir along with water and formation fines. The materials from the formation eventually plug the perforations over time. When the perforations become plugged, the hydrocarbon flow is reduced. The hydrocarbons must find another flow path until eventually the majority of the perforations are plugged and production is reduced substantially compared to potential production if all of the perforation flow paths were open.

Current methods for cleanup of perforations are highly inefficient, commonly involving bull heading of acids from the surface to clean up the components of the perforation material that are both acid soluble and are accessible during injection. However, not all materials lodged in perforations are acid soluble. In many cases, acid or solvents are injected to clean perforations, the stimulants may preferentially leak off into perforations with the highest-permeability streaks, leaving large intervals which are under stimulated due to perforations that are still plugged in portions of the reservoir with lower permeability. Methods to stimulate lower permeability's with diverting agents have had some measure of success.

Chemical, mechanical and hydraulic methods have been proposed for decreasing or removing damage to flow in perforations. An example of a hydraulic method is that disclosed in U.S. Pat. No. 5,060,725 (incorporated herein by reference in its entirety), where the use of multiple jets created by pumping fluid downhole and through a tool containing multiple nozzles is disclosed. The tool is rotated and reciprocated inside a casing while pumping high-pressure fluid through the nozzles to wash perforations. Jet drilling of drain holes from wells is also well known. For example, U.S. Pat. No. 6,668,948 (incorporated herein by reference in its entirety) discloses a nozzle suitable for drilling through the casing of a well to form a perforation and then continued drilling into the surrounding formation before the nozzle is withdrawn into the well. Canadian Patent 2,098,000 (incorporated herein by reference in its entirety) describes a perforation cleaning tool based on a fluidic oscillator which produces pressure pulsations which induce cyclical stresses on the walls of the perforations.

U.S. Pat. Nos. 2,915,122, 5,836,393, 8,113,278, 9,863,225 and 1,107,081, PCT Publication Nos. WO 2008054256 and WO 2016167666, as well as Spanos et al., Proceedings of the 50$^{th}$ CIM Petroleum Society Annual Technical Meeting, Calgary, Alberta, June 1999, and Dusseault et al., Proceedings of the 10$^{th}$ EAGE European Symposium on IOR, Brighton, England, August 1999 (each incorporated herein by reference in its entirety), describe various techniques and devices used to generate pressure waves to increase production from a well.

U.S. Pat. Nos. 4,407,365, 5,836,389, 7,669,651 and PCT Publication No. WO 2016209084 (each incorporated herein by reference in its entirety) describe downhole tools which include pressure and vibration generating devices for various purposes such as enhancing fracturing, hydraulic jar operations, preventing fluid flow in a cemented annulus by vibrating the casing, generating data to assist in optimizing pumping parameters, and improving percussion drilling.

There continues to be a need for cleaning perforations in efforts to increase production from oil or gas wells.

SUMMARY

In accordance with one embodiment, there is provided a device for generating pressure waves in a well or a wellbore. The device includes a housing containing an impact-generating mechanism for generating the pressure waves and a connector for connecting the housing to a conveyor for transporting the device to any desired location within the well or the wellbore.

The impact-generating mechanism may include a piston contained within a cylinder. The piston is configured to impact an upper surface of an anvil.

The device may include a pressure wave outlet located below the anvil. The pressure wave outlet may be defined by a plurality of openings permitting propagation of the pressure waves from inside the device into fluid contained in the well or wellbore.

The cylinder may be configured to provide a piston stroke which is longer than half of the length of the piston. In other embodiments, the piston stroke may be at least about twice as long as the length of the piston or about three times as long as the length of the piston.

The upper surface of the anvil may be located above the pressure wave outlet and a bottom surface of the anvil may be located within a cavity of the pressure wave outlet.

The anvil may have a constricted middle portion and a flared bottom portion.

The device may include one or more seals between the outer sidewall of the anvil above the constricted middle portion and the inner sidewall of the pressure wave outlet, wherein working fluid contacts the anvil below the one or more seals.

The anvil may include an upper radial extension below the contact surface, wherein a lower surface of the radial extension is adjacent to an upper surface of the pressure wave outlet.

The plurality of openings may be at least one set of three radially aligned elliptical or stadium-shaped openings.

The connector may be configured for connection to a coiled tubing conveyor or a wireline conveyor.

The device may be configured for operation by a pneumatic control system with the device including a plurality of valves configured to fire the piston and to return the piston to a firing position and vent air from the device.

The pneumatic control system may be further configured to purge the device with an airflow to remove fluid and/or contaminants from the device when the impact-generating mechanism is not operating.

The pneumatic control system may be further configured to provide a gas spring between the lower surface of the upper radial extension of the anvil and the upper surface of the pressure wave outlet.

The plurality of valves may be located in a control system housing located above the impact generating mechanism.

The device may further include one or more pneumatic pilot circuits extending between the cylinder and at least one of the valves of the plurality of valves to provide switching between a purge mode and an operational mode by only controlling the air pressure conveyed into the device past a pre-set pressure threshold.

The plurality of valves may include a purge valve to switch between the purge mode and the operating mode; a vent check valve to provide a path to vent air from the device; an outlet valve to provide a path to vent air from the device and to prevent ingress of fluids into the device; and a primary control valve to switch between a piston firing mode and a piston return mode.

The plurality of valves may include a vent check valve to provide a path to vent air from the device; an outlet valve to provide a path to vent air from the device and to prevent ingress of fluids into the device; a pair of solenoid-actuated spool valves under electronic control to actuate the outlet valve and the primary control valve; and a primary control valve to switch between a piston firing mode and a piston return mode.

The device may include a filter housing located between the control system housing and the connector. The filter housing is provided to filter air entering the device via the conveyor.

According to another embodiment, there is provided a system for generating downhole pressure waves. The system includes any of the pressure wave generating device embodiments described herein, which is connected to an end of a length of coiled tubing. The system also includes a pressure-controllable air supply unit for conveying pressurized air to the device via the coiled tubing. The device may be configured to switch between a low pressure purge mode and a cycling operating sequence when the air supply unit is controlled to provide an air pressure in the device which is above a pre-determined threshold pressure.

Any of the embodiments of the pressure wave generating device described herein may be used for cleaning perforations in a casing to improve hydrocarbon production, used for a downhole hydraulic jar operation for freeing stuck objects, used in a hydraulic fracturing process, used for generating data to optimize pumping parameters, used for preventing fluid flow in a cemented annulus or used in a percussion drilling operation.

BRIEF DESCRIPTION OF THE DRAWINGS

Various aspects of the invention will now be described with reference to the figures. The invention may, however, be embodied in many different forms and should not be construed as limited to the embodiments set forth herein; rather, these embodiments are provided so that this disclosure will be thorough and complete, and will fully convey the scope of the invention to those skilled in the art.

Emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

In describing the figures, similar reference numbers are used to refer to similar elements wherever possible. In the figures, the thickness of certain lines, layers, components, elements or features may be exaggerated for clarity.

FIG. 1 is a representative side view of one embodiment of a downhole pressure wave generating device 10.

FIG. 2A is a cross section of the device 10 shown in FIG. 1 indicating an area 2B which is magnified in FIG. 2B.

FIG. 2B is a magnified area of the cross section of the device 10 shown in FIG. 2A.

FIG. 2C is a cross section of the device 10 shown in FIG. 1 which is identical to the cross section view of FIG. 2A with the exception of indicating a different area 2D which is magnified in FIG. 2D.

FIG. 2D is a magnified area of the cross section of the device 10 shown in FIG. 2C.

FIG. 3A is a first cross section of a pneumatic valve-driven control system housed in the control system housing 18.

FIG. 3B is a second cross section of the pneumatic valve-driven control system housed in the control system housing 18.

FIG. 3C is a third cross section of the pneumatic valve-driven control system housed in the control system housing 18.

FIG. 3D is a fourth cross section of the pneumatic valve-driven control system housed in the control system housing 18, which is similar to the magnified cross section of FIG. 2A.

FIG. 4 is a schematic diagram indicating valves, ports, circuits and orifices of the control system and device 10.

DETAILED DESCRIPTION

Introduction and Rationale

Figure 1:
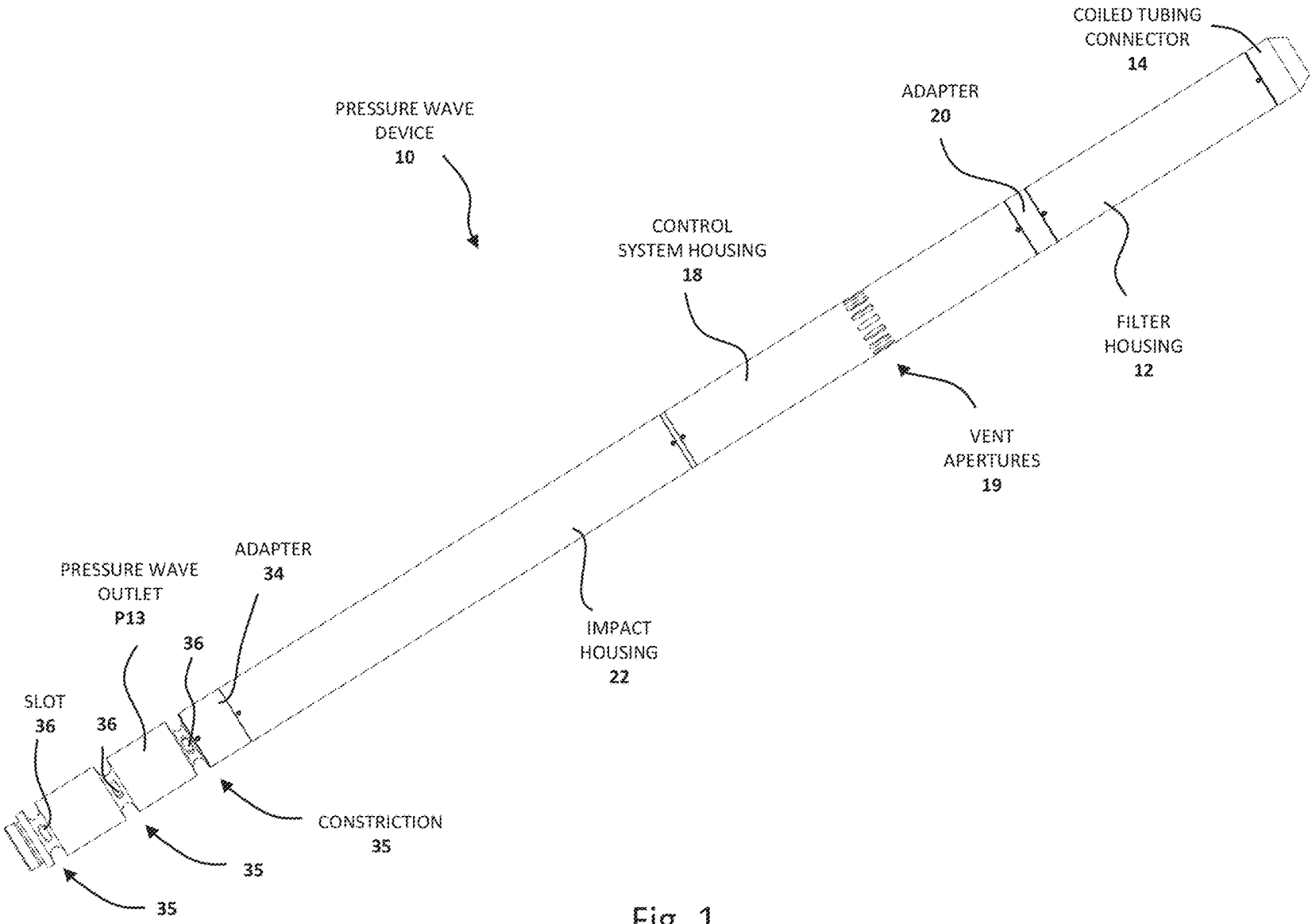

As noted above in the Background section, cleaning of perforations to improve productivity of oil and gas wells is a desirable goal. The present inventor has recognized a need for device configured for downhole conveyance to perforations requiring cleaning and has developed embodiments of a pressure wave generating device based on an impact-generating mechanism for this purpose.

Embodiments of the device described herein create pressure waves in a working fluid and propagate them through the fluid into the casing, perforations and reservoir to improve production of the desired fluid. The pressure waves are created by causing a piston to strike an anvil thereby producing high amplitude pressure waves at the interface between the anvil and the working fluid. The piston accelerates at high speed and strikes the anvil that is stationary at the time of impact. In one embodiment, the produced pressure waves propagate through a fluid passage and exit the device between the tool and the casing. The exiting pressure waves are focused by sets of radial slots in a pressure wave outlet to produce a maximum amplitude pressure waves at the casing wall.

The inventor has further recognized that embodiments of the device described herein may be conveniently used in other applications which benefit from generation of pressure waves at specific locations, such as fracturing processes, vibration of a casing to prevent fluid flow in a cemented annulus, generating data to optimize pumping parameters and as an enhancement to percussion drilling techniques, among others. To date, examples of devices using hammer mechanisms to generate downhole pressure waves have been identified in U.S. Pat. Nos. 9,863,225, 10,107,081 and in PCT Publication No. WO 2008054256. Among these, only PCT publication No. 2008054256 describes a hammer mechanism which itself is placed at a downhole location (the other two documents describe hammer mechanisms located at the surface). In the device of PCT Publication No. WO 2008054256, the hammer mechanism is located on the bottom cement plug. Therefore, it appears that pressure wave generating devices based on hammer mechanisms which are configured for deployment to specific downhole positions have not yet been envisioned. Embodiments of the device and control system described herein address the need for a versatile conveyable device for generating downhole pressure waves at any desired downhole location for enhancing production of hydrocarbons and other applications, such as fracturing processes, vibration of a casing to prevent fluid flow in a cemented annulus, hydraulic jar operations for freeing stuck downhole objects, generating data to optimize pumping parameters and as an enhancement to percussion drilling techniques.

Various aspects of the invention will now be described with reference to the figures. For the purposes of illustration, components depicted in the figures are not necessarily drawn to scale. Instead, emphasis is placed on highlighting the various contributions of the components to the functionality of various embodiments. A number of possible alternative features are introduced during the course of this description. It is to be understood that, according to the knowledge and judgment of persons skilled in the art, such alternative features may be substituted in various combinations to arrive at different embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise. The terms "upstream" and "downstream" are used in this description to indicate the direction of fluid flow.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present.

It will be understood that, although the terms "first", "second", etc. may be used herein to describe various elements, components, etc., these elements, components, etc. should not be limited by these terms. These terms are only used to distinguish one element, component, etc. from another element, component. Thus, a "first" element, or component discussed below could also be termed a "second" element or component without departing from the teachings of the present invention. In addition, the sequence of operations (or steps) is not limited to the order presented in the claims or figures unless specifically indicated otherwise.

Overview of an Embodiment of a Device for Generating Pressure Waves

An overview of one example embodiment of a device for generating downhole pressure waves will now be described with reference to FIGS. 1 to 4. As used herein, the term "downhole" is used in the energy industry to generally refer to an environment below the ground within an oil or gas well or in a borehole. This example embodiment is pneumatically operated. However, it is to be understood that alternative embodiments are envisioned and may be constructed with electronic control or with control by any suitable combination of pneumatic and electronic control components. The main features of the device 10 will be described first, followed by a detailed description of the main functional components and operating sequences of the device 10. This device 10 is configured for pneumatic control and does not include any electronically controlled components. Alternative embodiments which include electronically controlled components will be described below.

FIG. 1 indicates that the generally tubular pressure wave device 10 includes, from top to bottom in the operational orientation, a coiled tubing connector 14 connected to a filter housing 12, an adapter 20, a control system housing 18 provided with vent apertures 19, a lower impact housing 22, another adapter 34 and a pressure wave outlet P13 which has three constricted areas 35, each provided with three radial stadium-shaped slots 36. In alternative embodiments a different type of conveyor is connected using a different connector, such as a wireline connector for a wireline downhole conveyor system, for example.

Turning now to FIGS. 2A to 2D, there is shown a selected cross-section of the device 10. It is to be understood that different cross-sections of the device 10 have different pneumatic circuit conduits and as such, different cross sections will reveal different pneumatic circuits and other components contributing to the functionality of the device 10 to be described hereinbelow with reference to FIGS. 3A-3D.

Figure 2A:
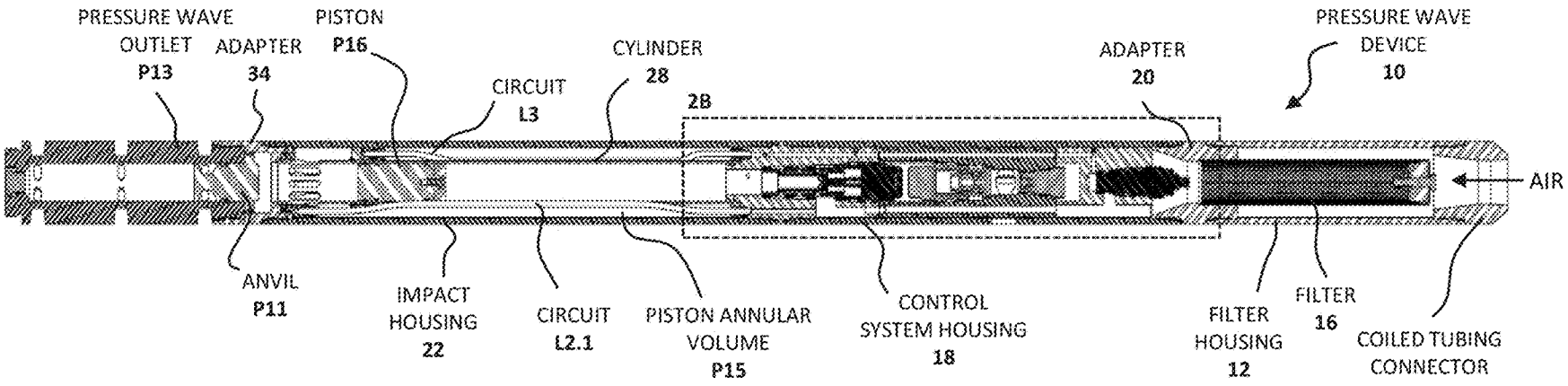

FIG. 2A indicates that the device 10 includes of a series of upper tubular housings and adapters, including the upper filter housing 12, the control system housing 18 and the impact housing 22 which is connected at its lower end to a pressure wave outlet P13. The filter housing 12 has the coiled tubing connector 14 connected to its upper end, thereby providing a means of conveyance of the device 10 to any desired downhole location. The filter housing 12 is connected to the adapter 20 which reversibly holds a filter 16 provided for the purpose of filtering pressurized air conveyed down the coiled tubing and into the filter housing 12 as indicated by the leftward pointing arrow. The filter 16 cleans the pressurized air and prevents contaminants from entering the main functional areas of the device 10. If required, the filter 16 can be changed by decoupling the coiled tubing from the coiled tubing connector 14 and decoupling the filter housing 12 from the adapter 20 to expose the filter 16. The filter housing 12 and filter 16 may be considered optional and omitted from alternative embodiments, for example, when a reliable pre-filtered supply of pressurized air is available.

Figure 2B:
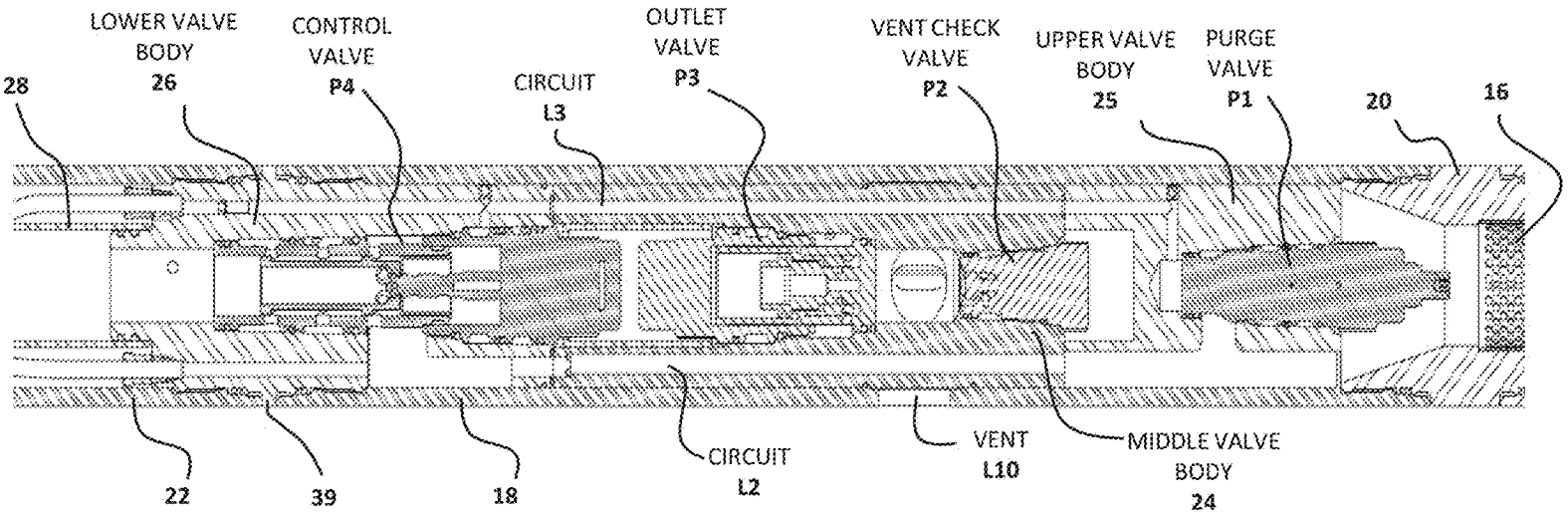

The adapter 20 provides a means for connecting the filter housing 12 to the control system housing 18. The control system housing 18 holds a set of four valves. FIG. 2B illustrates a magnified area of the device shown in FIG. 2A indicated by frame 2B to provide more detail with respect to these four valves as well as two of the pneumatic circuits L2 and L3 of the device (other pneumatic circuits are seen in FIGS. 3A to 3D) and vent L10. It is seen in FIG. 2B that the control system housing 18 is coupled to the adapter 20. The lowermost portion of the control system (left side of FIG. 2B) is formed by lower valve body 26 which is coupled to the control system housing 18. A middle valve body 24 is located above the lower valve body 26 and an upper valve body 25 is located above the middle valve body 24 (right side of FIG. 2B).

The arrangement of the four valves placed in the three valve bodies of the control system will first be briefly described, followed by a description of the features of the valves themselves. The upper valve body 25 has a cavity and conduits which operate with a low pressure pilot-operated two-way purge valve P1. The middle valve body 24 has a cavity configured to hold a two-way vent check valve P2 and a pilot-operated two-way outlet valve P3. The lower valve body 26 has a cavity and conduits which operate with a four-way pilot operated control valve P4. It can be seen in FIGS. 2A and 2B that conduits for pneumatic circuits are formed in valve bodies 24, 25 and 26 which extend past the control system housing 18 including pneumatic circuits L2, L2.1 and L3, whose functions will be described in more detail hereinbelow, as well as vent L10 which is formed in the control system housing 18, extending through middle valve body 24. The vent apertures 19 shown in FIG. 1 are aligned with the vent L10. This particular arrangement of valves represents one embodiment. Alternative arrangements having fewer or more valves may be provided in alternative embodiments.

It is seen in FIG. 2A, that an impact housing 22 is connected below the control system housing 18, via the lower valve body 26 which includes a lower shoulder 39 serving as an adapter for connecting the control system housing 18 to the impact housing 22. The impact housing 22 holds an impact-generating mechanism in the form of a piston P16 and anvil P11. The piston P16 is held within a cylinder 28. In FIG. 2B, it can be seen that the upper end of the cylinder 28 is connected to the lower valve body 26. The cylinder 28 has a significantly smaller diameter than the diameter of the impact housing 22 and therefore, there is a space therebetween referred to herein as the piston annular volume P15.

It is also shown in FIG. 2A that an adapter 34 is connected to the lower end of the impact housing 22 and that a pressure wave outlet P13 is connected to the lower end of the adapter 34.

Figure 2C:
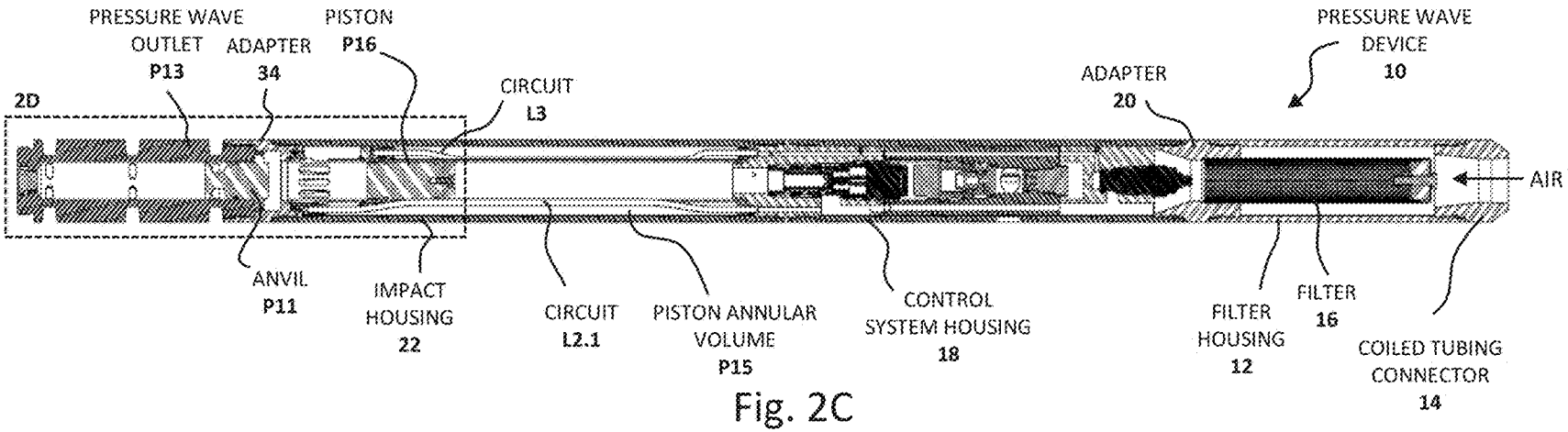
Figure 2D:
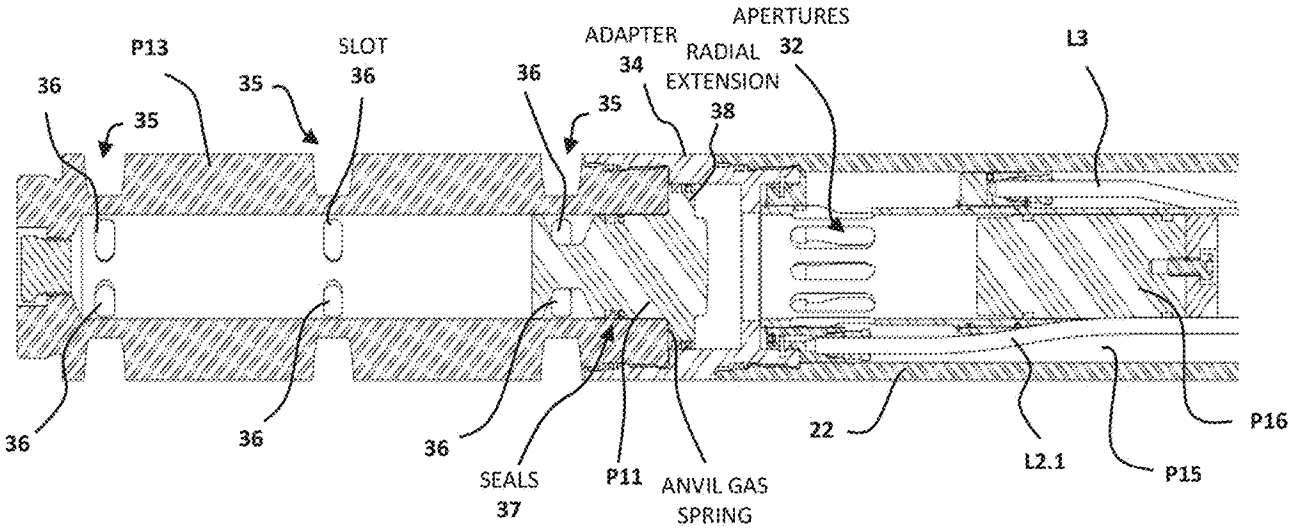

FIG. 2C is identical to FIG. 2A with the exception of indicating the position of a lower area of the device (frame 2D) which is magnified in FIG. 2D. FIG. 2D shows that the cylinder 28 terminates above the lower end of the impact housing 22. The cylinder 28 has radial apertures 32 at its lower end. There is a cavity which accepts high pressure air via conduit L2.1 to provide an air cushion which is referred to herein as the anvil gas spring P12, whose function will be described in more detail hereinbelow.

The lower end of the adapter 34 forms a connection to the pressure wave outlet P13. Three sets of three radial slots 36 are formed in each one of three constrictions 35 in the pressure wave outlet P13 which permit pressure waves generated by the impact-generating mechanism to be propagated from the device 10. In this particular embodiment, the radial slots are stadium shaped. Other shapes such as ellipses and circles may be incorporated into alternative embodiments which may have more or fewer sets of slots with more or fewer slots in each set. In the present embodiment of the device 10, it has been determined that three sets of three slots 36 provides a useful balance between performance, cost and size.

The generated pressure wave intensity and frequency are controlled by the impact energy between the piston P16 and the anvil P11 and the frequency of impacts between the piston P16 and the anvil P11. In the main embodiment described herein, the device 10 uses a mechanically controlled system of pneumatic valves to cause the device 10 to fire the piston P16 and return the piston P16 at a defined rate. The impact energy is controlled by varying the differential pressure between the supplied pressure and the reservoir pressure which defines the energy transferred to the working fluid upon impact between the piston P16 and the anvil P11. In alternative embodiments described below, at least some of the valves are electrically controlled.

One advantageous feature of the control system described herein is that it allows construction of a piston stroke that is longer than half the length of the piston P16. In a conventional jackhammer construction, the circuit that causes the piston to fire and return is integrated into the piston and requires that the piston be at least twice as long as the stroke of the piston. This requirement means that the impact velocity is severely limited. In the control system described herein, the stroke of the piston can be equal to or greater than the piston length by any amount required by the application. For example, the piston stroke may be at least about twice as long as the length of the piston or about three times as long as the length of the piston. The primary benefit is that much higher velocities and therefore energy densities in the piston are achievable.

Pneumatic Components

A more detailed description of the pneumatic components and their functions will now be provided. This will be followed by a detailed description of the operating sequence of the device and control system which will provide additional clarity regarding the functionality of these main components of the device 10 and control system. Connections between components in the device 10 are shown in the cross sections of the device 10 in FIGS. 3A-3D and in the schematic circuit diagram in FIG. 4. A list of components (including valves, orifices and volumes) and pneumatic circuits is provided in Tables 1 and 2 below with reference identifiers used in this description.

TABLE 1

System Components and Volumes

| Reference Identifier | Description |
|---|---|
| P1 | Low Pressure Purge Valve |
| P2 | Vent Check Valve |
| P3 | Outlet Valve |
| P4 | Primary Control Valve |
| P5 | Piston Return Orifice |
| P6 | Primary Pilot Check Valve |
| P7 | Primary Pilot First Orifice |
| P8 | Primary Pilot Second Orifice |
| P9 | Piston Position Sense Orifice |
| P10 | Gas Spring Check Valve |
| P11 | Anvil |
| P12 | Anvil Gas Spring |
| P13 | Pressure Wave Outlet |
| P14 | Air Volume Ahead of Piston |
| P15 | Piston Annular Volume |
| P16 | Piston |
| P18 | Coiled Tubing Unit |

TABLE 2

Pneumatic Circuits

| Reference Identifier | Description |
|---|---|
| L1 | Coiled Tubing |
| L2.0 | High Pressure Supply |
| L2.1 | Anvil Return High Pressure Supply |
| L3 | Piston Position Sense |
| L4 | Vent |
| L5 | Piston Return Supply |
| L6 | Primary Pilot Piston Side |
| L7 | Secondary Pilot |
| L8 | Primary Pilot Valve Side |
| L9.0 | Primary Drain |
| L9.1 | Low Pressure Purge Valve Drain |
| L10 | Outlet |

Low Pressure Purge Valve P1

The low pressure purge valve P1 is a spool-type valve housed in the upper valve body 25 of the control system. This valve P1 has four ports which are used for pilot control and switching of the device 10 between a low pressure purge mode and the active operating mode. The main purpose of valve P1 is to control the connection of a high pressure air supply circuit L2.0 transmitted from the coiled tubing to a piston position sensing circuit L3. The low pressure purge valve P1 operates as follows: when the air pressure transmitted through the coiled tubing is below the switching pressure of valve P1, the air pressure is transmitted through the body of the device 10 to purge any fluid or contaminants which may have entered the device 10. This lower air pressure also serves to ensure that the piston P16 remains in its impact position against the anvil P11 during this purge operation. In this configuration, low pressure purge valve P1 connects the high pressure supply circuit L2.0 to the piston position sensing circuit L3. When the pressure of air transmitted through the coiled tubing L1 is increased above the switching pressure of the low pressure purge valve P1, this valve is switched to isolate the piston position sensing circuit L3 from the high pressure supply circuit L2.0. This ends the purge operation. In this example embodiment, the switching threshold pressure is 300 psi. However, different switching thresholds may be configured in alternative embodiments.

Vent Check Valve P2

The vent check valve P2 is housed in the middle valve body 24. The vent check valve P2 provides a path for air to exit the device 10 under all operating conditions. The vent check valve P2 provides an exit for air pushed out of the cylinder 28 during the firing cycle when the piston P16 moves downward towards impact with the anvil P11. Vent check valve P2 also provides an air drain outlet for the low pressure purge valve P1 and allows air to vent out of the device 10 during the low pressure purge.

Outlet Valve P3

The outlet valve P3 is housed in the middle valve body 24, below the vent check valve P2. This valve P3 provides a high flow controlled path for air to exit the device 10 and prevents ingress of wellbore fluids into the device 10. During operation, valve P3 provides a low restriction flow path for air contained in the cylinder 28 between the piston and the anvil P11. This volume is designated as the "air volume ahead of the piston" and is indicated by P14 in FIG. 4. Additionally, the air in in the piston annular volume P15 during the firing cycle of the hammer mechanism also moves through outlet valve P3 (which is described in more detail hereinbelow). Outlet valve P3 also prevents air from exiting from the P14 and P15 volumes during the return cycle (which is described in more detail hereinbelow).

Primary Control Valve P4

The primary control valve P4 is housed in the lower valve body 26 and switches between firing of the hammer mechanism and returning the hammer mechanism to the firing position after it has been fired (the return cycle). The primary control valve P4 is pilot-operated and uses the pressure difference between port 5 and port 6 (see FIGS. 3A, 3D and 4) to control the selection of firing and return modes.

In the firing configuration, valve P4 connects the high pressure supply circuit L2.0 to the space behind the piston P16, causing acceleration of the piston P16 downward towards the anvil P11. In this same configuration, the valve P4 also connects the air volumes P14 and P15 to the vent check valve P2 via the piston return orifice P5.

In the return configuration, valve P4 connects the high pressure supply L2.0 to the air volumes P14 and P15 ahead of the piston P16 via the piston return orifice P5. In this same configuration, the valve connects the air volume behind the piston to the vent check valve P2.

Return Supply Orifice P5

Figures 3A, 3B, 3C, 3D:
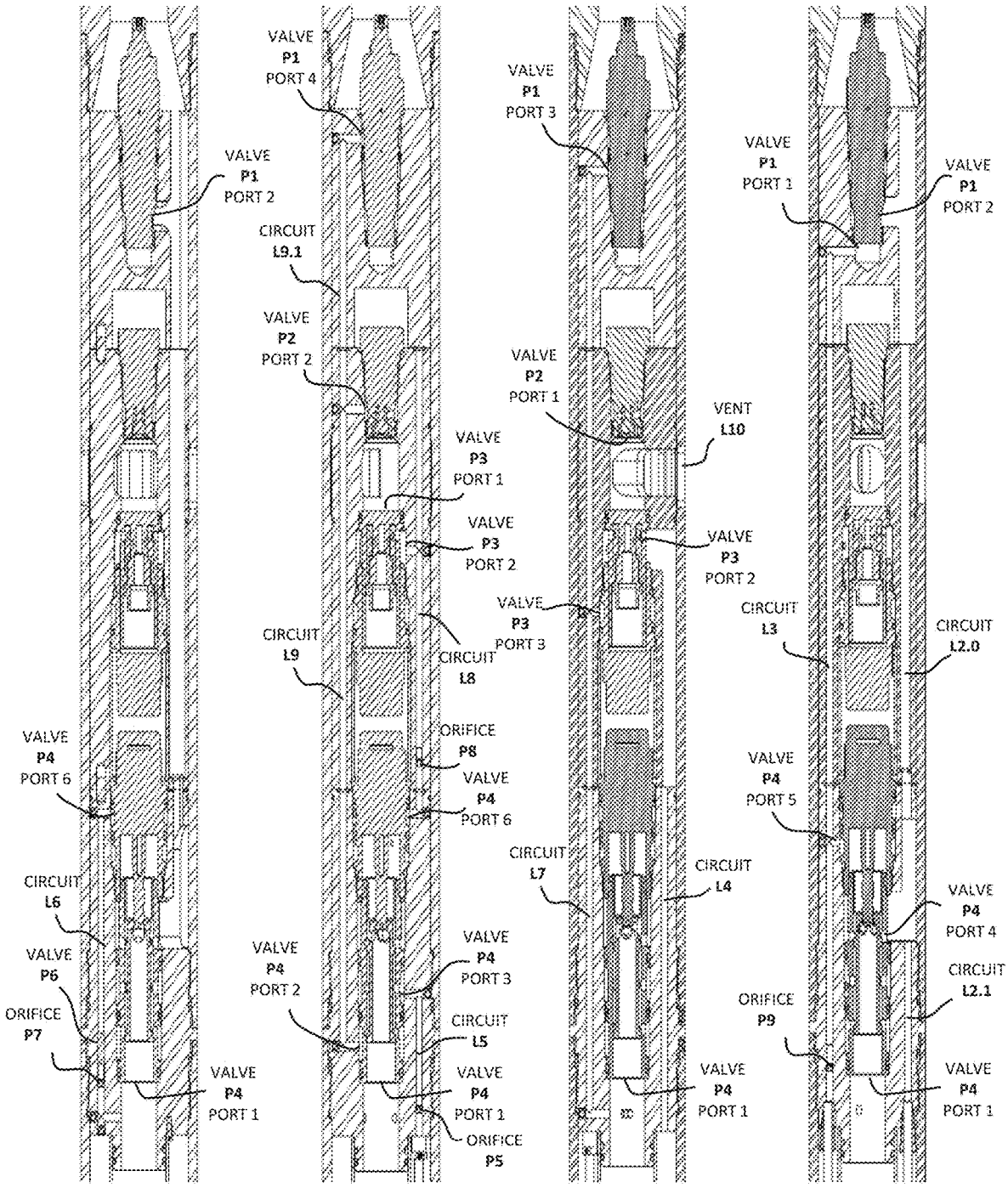
Figure 4:
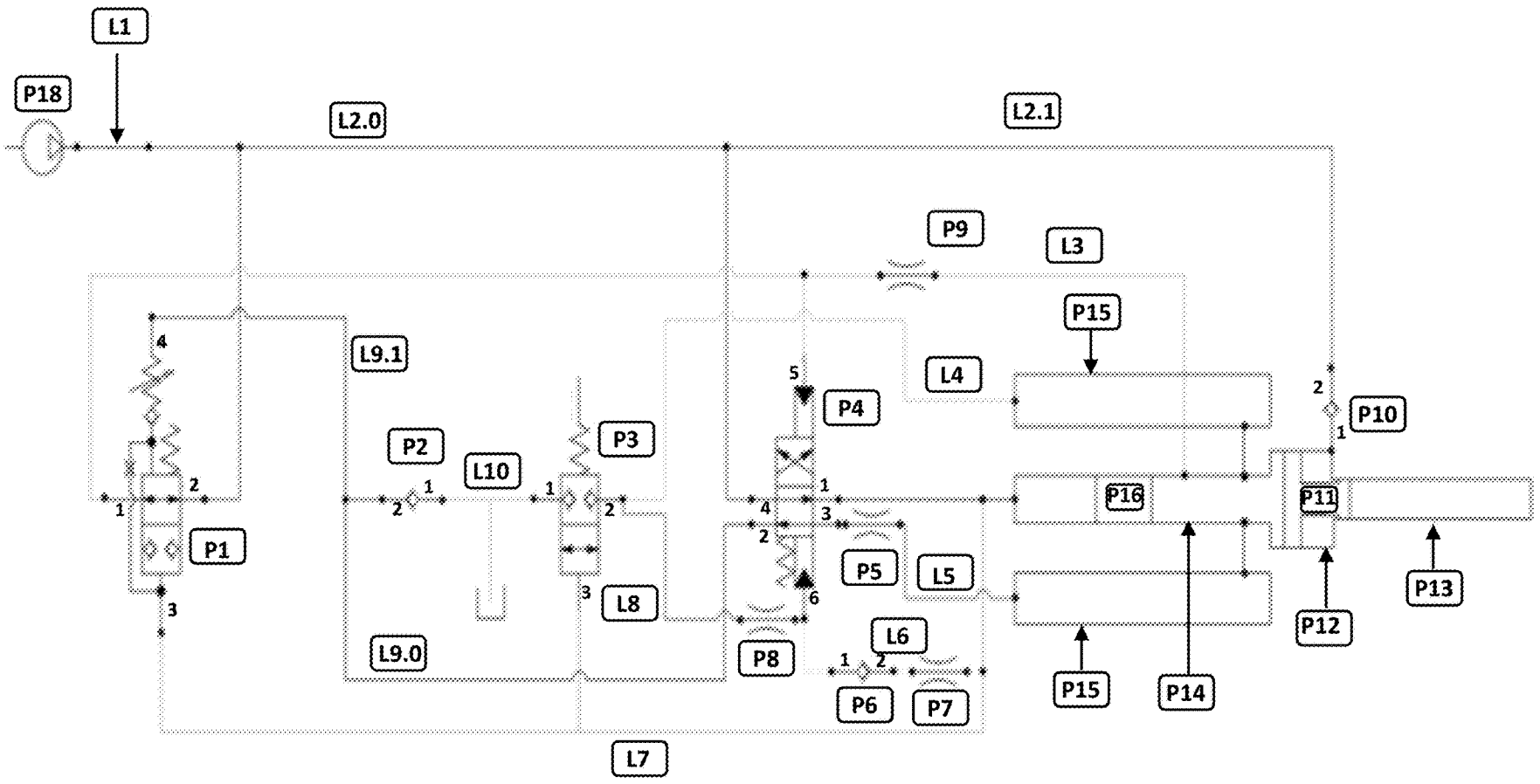

The return supply orifice P5 is located in circuit L5 (piston return supply circuit) which leads from the annular volume P15 to port 3 of valve P4 (see FIGS. 3B and 4). This orifice P5 supplies air at a regulated rate to return the piston P16 to its firing position during the return mode and also provides a restricted path for air contained in volumes P14 and P15 to exit the device 10 during operation of the firing mode.

Primary Pilot Check Valve P6

The primary pilot check valve P6 (FIG. 4) is located in circuit L6 between port 6 of primary control valve P4 and the primary pilot first orifice P7 (see FIGS. 3A and 4). This valve P6 is sealed at the end of the return stroke to create a condition where the pilot pressure is equal between ports 5 and 6 of the primary control valve P4. This causes valve P4 to be shifted by its internal spring. In operation, valve P6 prevents flow in circuit L6 during the return mode and maintains high pressure on port 6 of the primary control valve P4. During the firing mode, flow through P6 is allowed and this maintains intermediate pressure on port 6 of the primary control valve P4.

Primary Pilot First Orifice P7

The primary pilot first orifice P7 is located in the primary pilot piston side circuit L6 adjacent to the pilot check valve P6. The purpose of the primary pilot first orifice P7 is to create an intermediate pressure at port 6 of the primary control valve P4. When the device 10 is in the firing mode, a pressure drop is created by primary pilot first orifice P7 at port 6 of the primary control valve P4.

Primary Pilot Second Orifice P8

The primary pilot second orifice P8 is located in primary pilot valve side circuit L8 between port 6 of primary control valve P4 and port 2 of outlet valve P3. The purpose of the secondary pilot second orifice P8 is to create an intermediate pressure at port 6 of valve P4. This causes a pressure drop at port 6 of valve P4 when the tool is in the firing mode.

Piston Position Sense Orifice P9

The piston position sense orifice P9 is located in the piston position sense circuit L3 between port 2 of low pressure purge valve P1 and the air volume ahead of the piston P14. The purpose of piston position sense orifice P9 is to provide a restriction to flow in the piston position sense circuit L3. In the firing sequence set (described in detail hereinbelow), there is no flow in circuit L3 and thus there is no resistance to flow at orifice P9. In the return sequence set, the orifice L9 creates a high pressure at port 5 of the primary control valve P4, causing it to switch to and remain in the return position.

Gas Spring Check Valve P10

The gas spring check valve P10 (see FIG. 4) is located in the anvil return high pressure supply circuit L2.1 between the branch point separating circuit L2.0 and circuit L2.1 and the anvil gas spring P12 (see FIG. 2D and FIG. 4), which is a cushion of air that prevents the anvil P11 from reaching a hard stop after impact of the piston P16 on the anvil P11. The purpose of the gas spring check valve P10 is to allow high pressure air to charge the anvil gas spring P12 but to prevent high pressure air from escaping after impact of the piston P16 on the anvil P11.

Pneumatic Hammer Mechanism

The pneumatic hammer mechanism of the device 10 is formed by components contained within the impact housing 22 including cylinder 28 containing piston P16 and pneumatic circuits L2.1 and L3, which can be seen in FIGS. 2C and 2D running along the length of the cylinder 28. The pressure on either side of the piston P16 is contained within the cylinder 28 during operation. The cylinder 28 has apertures 32 at its lower end which permit free flow of air from the air volume ahead of the piston P14 to the piston annular volume P15.

The piston P16 moves within the cylinder 28 and seals at the top of the return stroke. There is minimal bypass between the piston P16 and the cylinder 28 during the firing and return strokes. The piston P16 is prevented from damaging the interior of the cylinder 28 via the incorporation of wear rings or by being formed of material which does not damage the interior of the cylinder 28 under high speed contact. The piston P16 also has an impact surface which is either flat or convex. When the piston P16 is in contact with the anvil P11, a high pressure above the piston P16 is maintained and transmitted through the piston position sense circuit L3.

The anvil P11 is in contact with the working fluid and transmits the impact energy from the piston P16 to the working fluid. As used herein, the term "working fluid" refers to any gas or liquid or mixture thereof which primarily transfers force, motion or mechanical energy. The anvil P11 is returned to its normal position using the gas spring P12 which is supplied with high pressure via circuit L2.1 as noted above. The gas spring P12 prevents the anvil P11 from reaching a hard stop against the upper edge of the pressure wave outlet P13 after impact by the piston P16 on the upper surface of the anvil P11. Alternative embodiments may include a mechanical spring, a magnetic spring or a hydraulic spring instead of a gas spring or a combination of a gas spring with a mechanical spring, hydraulic spring or magnetic spring. The anvil P11 has a piston contacting surface which may be either flat, convex or concave to cooperate in generating the impact with an appropriate flat, or complementary concave or convex anvil contacting lower surface on the piston P16. In this particular embodiment, the anvil P13 incorporates O-ring energized polytetrafluoroethylene cap seals 37 with a labyrinth incorporated on the working fluid seal (see FIG. 2D). The anvil may incorporate other types of sealing mechanisms to prevent ingress of working fluid upwards into the device 10 from the pressure wave outlet P13 or to prevent escape of compressed air. A labyrinth seal is a type of mechanical seal which provides a tortuous path to prevent leakage.

The anvil P11 may incorporate features for providing mechanical amplification of the displacement of the interface between the fluid and the anvil P11 which is caused by the impact of the piston P16 on the anvil P11. In the present embodiment, the anvil P11 is shaped with a wide impact area which includes the upper impact surface, a constricted lower portion and a bottom flared portion (best seen in FIG. 2D) to create a mechanically amplified impact effect similar to the effect produced by an ultrasonic horn which is excited at its natural frequency by the impact.

The anvil P13 includes an upper radial extension 38 which extends past the upper surface of the pressure wave outlet P13. The anvil gas spring P12 is provided between the lower surface of the radial extension 38 of the anvil P11 and the upper surface of the pressure wave outlet P13.

Pressure Wave Outlet

As seen in FIG. 2D, the anvil P11 is partially housed by adapter 34 and extends into the pressure wave outlet P13. The contact surface of the anvil P11 is retained in place above the upper surface of the pressure wave outlet P13. Adapter 34 connects the pressure wave outlet P13 to the impact housing 22 as shown in FIG. 1.

The pressure wave outlet P13 is filled with working fluid and prevents compressible fluids from being trapped in the path of the pressure waves. This component seals against the anvil P11 as described above, to prevent ingress of working fluid into the spaces of the device 10 above the anvil P11. Pressure waves formed at the flat interface of the flared portion of the anvil P11 and the working fluid are propagated to the radial slots 36 formed in the constrictions 35 in the pressure wave outlet P13. This focuses the pressure waves outward against the sidewall of the casing or borehole. In some embodiments, the pressure wave outlet P13 is provided with appropriately placed sensors for measuring the produced pressure waves and a means for transmitting the data to the surface for analysis.

Some alternative embodiments may have a modified pressure wave outlet to operate with an oversized anvil interface or may exclude the pressure wave outlet P13 such that the bottom portion of the anvil P11 is exposed directly at the bottom of the device. Alternative embodiments may include a diaphragm or bag between the anvil and the pressure wave outlets.

Operating Sequences

The operating sequences of the device, operated by the pneumatic control system, includes four sets of sequences; (i) a low pressure purge step; (ii) a first return step for returning the piston to the firing position, (iii) a main return step, and (iv) a firing step. Each of the steps are described individually hereinbelow for each of the sequence sets and follow the flow of air transmitted via the circuit L1 of the coiled tubing unit P18 through the device 10. An attempt is made to clearly indicate events which occur sequentially by indicating steps using Arabic numerals. The description of pressures at various points are with reference to differential pressure between the pressure at the inlet of the filtration section and the pressure in the reservoir at the vent L10. Table 3 provides a list of primary and secondary air flows in the four sequence sets.

is open and allows inlet air to flow through the piston position sense circuit L3. The vent check valve P2 is closed, allowing no air to flow therethrough. The outlet valve P3 is open to vent all air which enters the device 10. The primary control valve P4 is in the firing position which allows inlet air to flow from port 4 to port 1 (see FIG. 3D) of this valve to keep the piston P16 down against the anvil P11 (impact position). The primary control valve P4 also allows air to flow out of the tool from port 3 to port 2 and subsequently to the vent check valve P3 (see FIG. 3B).

First Return Sequence

In the present embodiment, the first return sequence set is initiated in step 1 when the pressure supplied to the device 10 via the coiled tubing unit P18 is increased to a pressure greater than 300 psi. However, in alternative embodiments, different threshold pressures may be selected to initiate the first return sequence set, as noted above.

TABLE 3

Primary and Secondary Air Flows in the Four Operating Sequence Sets

| | Operating Sequence Set | | | | | |
|---|---|---|---|---|---|---|
| | Primary Flow In (A) | Primary Flow In (B) | Primary Flow Out | Secondary Flow In | Secondary Flow Out (A) | Secondary Flow Out (B) |
| Low Pressure Purge (piston is down) | L1 → L2.0 → P4 (4 → 1) | — | L5 → P5 → P4 (3 → 2) → L9.0 → P2 → L10 | L1 → P1 (2 → 1) → P9 → L3 | — | — |
| First Return (initial movement from piston impact position) | L1 → L2.0 → P4 (4 → 1) | — | L4 → P3 (2 → 1) → L10 | — | L5 → P5 → P4 (3 → 2) → L9.0 → P2 → L10 | L7 → P7 → L6 → P6 → P8 → L8 → P3 (2-1) → L10 |
| Main Return (piston moving up) | L1 → L2.0 → P4 (4 → 3) → P5 → L5 | — | P4 (1 → 2) → L9.0 → P2 → L10 | L1 → P1 (2 → 1) → P9 → L3 | — | — |
| Firing (piston actuation) | L1 → L2.0 → P4 (4 → 1) | — | L4 → P3 (2 → 1) → L10 | — | L7 → P7 → L6 → P6 → P8 → L8 → P3 (2 → 1) → L10 | L5 → P5 → P4 (3 → 2) → L9.0 → P2 → L10 |

Low Pressure Purge

The purpose of the low pressure purge step is to ensure that the piston P16 is in the lowermost position, resting against the anvil P11 which is in its normal position. This step may be considered as an inactive state where pressure waves are not generated. In this state, air is transmitted through the device 10 to purge any reservoir fluids which may have entered into the device. In this state, there is no switching of positions of any of the valves of the device 10 and the range of air pressure transmitted through the tool is between zero and 300 psi (although it is to be understood that different pressure thresholds may be configured in alternative embodiments). As noted above, the primary valves of the control system are the purge valve P1, the vent check valve P2, the outlet valve P3 and the primary control valve P4. The status of each of these valves in the low pressure purge step are now described. The purge valve P1

In step 2, this pressure change causes the purge valve P1 to shift to its closed position to stop air flow from the high pressure supply circuit L2.0 and the piston position sense circuit L3.

In step 3, this pressure change also causes the vent check valve P2 to shift to its open position. As a result, the vent circuit L4 and the primary pilot valve side circuit L8 become equalized to the reservoir pressure. In addition, high pressure air flows from behind the piston through the primary pilot first orifice P7, primary pilot check valve P6 and primary pilot second orifice P8, creating an intermediate pressure at port 6 of the primary control valve P4. Furthermore, the differential pressure between ports 5 and 6 of the primary control valve P4 cause the valve to switch to the return position, initiating the main returning sequence.

Main Returning Sequence

This sequence is initiated in step 1 with the primary control valve P4 causing this valve to switch to the return position. This results in air pressure behind the piston P16 and in the secondary pilot circuit L7 being vented with pressure equalizing to reservoir pressure. The high pressure supply circuit L2.0 is connected to the piston return supply circuit L5 via the piston return orifice P5. This causes the pressure in the air volume ahead of the piston P14 to lift the piston P16 upwards to the firing position.

Next, in step 2, the pilot pressure on port 3 of the purge valve P1 drops to reservoir pressure and the purge valve P1 switches to its open position.

In step 3, there is no flow in the primary pilot circuits L6 and L8 and no flow in the vent circuit L4. The pressure at port 6 of the primary control valve P4 becomes equal to the pressure in the air volume ahead of the piston P14.

In step 4, air flows through the high pressure supply circuit L2.0 via the purge valve P1 and sets port 5 of the primary control valve P4 to supply pressure. Air flows through the piston position sense orifice P9, creating a large pressure drop which maintains high pressure on the upstream side and low pressure on the downstream side.

In step 5, the piston P16 rises towards its firing position at the top of the cylinder 28.

Firing Sequence

In step 1 of the firing sequence, the piston P16 reaches the firing position within the cylinder 28 and seals against its stop.

In step 2, the air volume ahead of the piston P14 equalizes to the supply pressure and there is no air flowing through the device 10.

In step 3, the pressures at port 5 and port 6 of the primary control valve P4 become equalized and the spring inside the primary control valve P4 causes it to switch to its normal position. This results in the high pressure supply circuit L2.0 being connected to the volume behind the piston, which creates high pressure in the secondary pilot circuit L7. The air volume ahead of the piston P14 is connected to the primary drain circuit L9.0.

In step 4, pressure on port 3 of the purge valve P1 increases and causes purge valve P1 to switch to its closed position.

In step 5, high pressure is exerted on port 3 of the outlet valve P3, causing this valve to switch to its open position, directly connecting the air volume ahead of the piston P14 to reservoir pressure.

In step 6, the high pressure behind the piston P16 enters the primary pilot piston side circuit L6. This causes air to flow through the primary pilot first orifice P7, creating a pressure drop. Air flows through the primary pilot check valve P6 and port 6 on the primary control valve P4 is set to an intermediate pressure. Air flows through the primary pilot second orifice P8 and pressure drops to reservoir pressure. Air flows through the outlet valve P3 and exits the tool. At this point, the primary control valve P4 is in a state which ensures that it will remain in the firing position.

In step 7, the piston P16 accelerates towards the anvil P11 until it achieves impact as this is happening, the air ahead of the piston P16 compresses and exits the device 10 via the apertures 32 at the end of the cylinder 28 and via outlet valve P3 and the vent check valve P2. One advantage provided by this arrangement is that the annular air volume minimizes the compression possible of the air ahead of the piston P16 so that even if the device 10 is slow to evacuate, the pressure that can be built up ahead of the piston P16 is relatively low.

When the piston P16 impacts the anvil P11, the piston P16 transfers energy to the anvil P11, accelerating the anvil suddenly into the working fluid. As a result, pressure waves are generated at the interface between the anvil P11 and the working fluid in the pressure wave outlet P13. These pressure waves propagate through the pressure wave outlet P13 and exit via the slots 36 formed in the pressure wave outlet P13. The anvil P11 moves downward and compresses the air in the anvil gas spring P12, slowing the downward movement of the anvil P11 and preventing contact between the anvil and the upper edges of the pressure wave outlet P13. Following impact, the first return sequence set is automatically initiated and the entire cycle will continue until the pressure supplied to the device 10 via circuit L1 of the coiled tubing unit P18 is manually decreased to below 300 psi to halt the cycle and switch to the low pressure purge, described above.

Alternative Control System Embodiments

The pneumatic control system described hereinabove may be replaced with an electronic control system. Two different alternative electronic control systems are briefly described, which require modifications to the device 10 described above.

Electronic Control System without Sensing

In this embodiment, the low pressure purge valve P1 of the device 10 is replaced with two solenoid-actuated spool valves which are used to actuate the outlet valve P3 and the primary control valve P4. In addition, the device 10 is modified to remove the piston position sensing circuit L3 and the orifice P9 which is in this circuit L3. The device 10 is also modified to remove the primary pilot circuits L6 and L8 and the orifices P7 and P8 and check valve P6 which are in these circuits L6 and L8. Further modification to device 10 is needed to add an electronic control circuit and an electric power supply. Optionally, a means for communicating the status of the valves to the surface is provided.

Electronic Control System with Sensing

In this embodiment, the low pressure purge valve P1 of the device 10 is replaced with two solenoid-actuated spool valves which are used to actuate the outlet valve P3 and the primary control valve P4. In addition, the device 10 is modified to add a pressure sensor to piston position sensing circuit L3 and to remove orifice P9 which is in this circuit L3. The device 10 is also modified to remove the primary pilot circuits L6 and L8 and the orifices P7 and P8 and check valve P6 which are in these circuits L6 and L8. Further modification to device 10 is needed to add an electronic control circuit and an electric power supply. A pressure sensor is added to the secondary pilot circuit L7. Optionally, a means for communicating the status of the valves to the surface is provided.

EXAMPLES

Example 1: Cleaning of Plugged Perforations in a Well Using a Pressure Wave-Generating Device with a Pneumatic Control System This example describes an application of an embodiment of the pressure wave-generating device 10 and its pneumatic control system described hereinabove, for cleaning of a series of sets of casing perforations in a well which are at least partially obstructed. In such an operation, the device is coupled to an end of a length of coiled tubing via the coiled tubing connector 14 and conveyed into the well to a position in the casing adjacent to first set of perforations such that the pressure wave outlet P13 of the device 10 is adjacent to or in close proximity to this first set of perforations.

During conveyance of the device 10 to this position via the coiled tubing, and prior to initiation of operation of the device 10, air at a pressure of less than 300 psi is conveyed into the upper end of the filter housing 12 of the device 10 via the coiled tubing, thereby ensuring that the device is in the low pressure purge state, which prevents reservoir fluids (gas or liquid or a combination thereof) from entering cavities of the device 10 above the anvil P11. However, reservoir fluids are permitted to enter the pressure wave outlet P13 via the slots 36 formed in the constrictions 35 of the pressure wave outlet P13. As such, the reservoir fluids contact the lowermost portion of the anvil P11 which resides within the interior space of the pressure wave outlet P13.

With the proper positioning of the pressure wave outlet P13 to a position adjacent to the set of casing perforations, operation of the device 10 is initiated simply by manually increasing the pressure above 300 psi. This causes the device 10 to initiate operation via the first return sequence set as described above. The device 10 will cycle through a series of impacts of the piston P16 on the anvil P11, generating pressure waves which propagate through the working fluid (reservoir liquids and/or gases or a combination thereof) contained in the pressure wave outlet P13 and exit the slots 36 in the pressure wave outlet P13. The pressure waves generated by the device 10 propagate through the working fluid and impact the material plugging the perforations and cause motion of the material, causing it to become dislodged, thereby cleaning the perforations and improving production of hydrocarbons therefrom.

It may be advantageous to clean the most distant sets of perforations first, followed by cleaning of closer sets of perforations. It may also be advantageous to provide the device with a flow sensor providing flow data in the vicinity of the pressure wave outlet P13. In such an embodiment, the flow sensor provides flow data prior to operation of the device 10 to clean the perforations and afterwards. This data will provide guidance regarding the extent of operation of the device 10 which would be required as a failure to observe an increased flow of hydrocarbons following operation may inform an operator that continued operation is necessary, while a significant increase in flow following operation may indicate that the perforations have been adequately cleaned and the increase in flow indicates that continued operation of the device 10 may not be necessary. Having the flow sensor in close proximity to the perforations, for example mounted on the pressure wave outlet P13, would increase the confidence level that an increased flow rate is provided by effective cleaning of the perforations by the device 10. If flow rate data confirms that the perforations have been adequately cleaned, the device 10 is then conveyed to a second set of perforations which is closer to the wellhead than the first set of perforations. The operation of the device is repeated at the second set of perforations and subsequently for as many sets of perforations as desired.

EQUIVALENTS AND SCOPE

Other than described herein, or unless otherwise expressly specified, all of the numerical ranges, amounts, values and percentages, such as those for amounts of materials, elemental contents, times and temperatures, ratios of amounts, and others, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

In the claims, articles such as "a," "an," and "the" may mean one or more than one unless indicated to the contrary or otherwise evident from the context. Claims or descriptions that include "or" between one or more members of a group are considered satisfied if one, more than one, or all of the group members are present in, employed in, or otherwise relevant to a given product or process unless indicated to the contrary or otherwise evident from the context.

It is also noted that the term "comprising" is intended to be open and permits but does not require the inclusion of additional elements or steps. When the term "comprising" is used herein, the term "consisting of" is thus also encompassed and disclosed. Where ranges are given, endpoints are included. Furthermore, it is to be understood that unless otherwise indicated or otherwise evident from the context and understanding of one of ordinary skill in the art, values that are expressed as ranges can assume any specific value or subrange within the stated ranges in different embodiments of the invention, to the tenth of the unit of the lower limit of the range, unless the context clearly dictates otherwise. Where the term "about" is used, it is understood to reflect +/−10% of the recited value. In addition, it is to be understood that any particular embodiment of the present invention that falls within the prior art may be explicitly excluded from any one or more of the claims. Since such embodiments are deemed to be known to one of ordinary skill in the art, they may be excluded even if the exclusion is not set forth explicitly herein.

The invention claimed is:

1. A device for generating pressure waves in a well or a wellbore, the device comprising:

a housing containing an impact-generating mechanism for generating the pressure waves, wherein the impact-generating mechanism comprises a piston contained within a cylinder, the piston configured to impact an upper surface of an anvil;

a pressure wave outlet located below the anvil, the pressure wave outlet defined by a plurality of openings permitting propagation of the pressure waves from inside the device into fluid contained in the well or wellbore, wherein the upper surface of the anvil is located above the pressure wave outlet and a bottom surface of the anvil is located within a cavity of the pressure wave outlet; and a connector for connecting the housing to a conveyor for transporting the device to any desired location within the well or the wellbore.

2. The device of claim 1, wherein the cylinder is configured to provide a piston stroke which is longer than half of the length of the piston.

3. The device of claim 2, wherein the piston stroke is at least about twice as long as the length of the piston.

4. The device of claim 3, wherein the piston stroke is about three times as long as the length of the piston.

5. The device of claim 1, wherein the anvil comprises a constricted middle portion and a flared bottom portion.

6. The device of claim 5, further comprising one or more seals between an outer sidewall of the anvil above the constricted middle portion and an inner sidewall of the pressure wave outlet, wherein working fluid contacts the anvil below the one or more seals.

7. The device of claim 1, wherein the anvil further comprises an upper radial extension below the upper surface of the anvil, wherein a lower surface of the radial extension is adjacent to an upper surface of the pressure wave outlet.

8. The device of claim 1, wherein the plurality of openings is at least one set of three radially aligned elliptical or stadium-shaped openings.

9. The device of claim 1, wherein the conveyor is a coiled tubing conveyor.

10. The device of claim 1, which is configured for operation by a pneumatic control system, the device including a plurality of valves configured to fire the piston and to return the piston to a firing position and vent air from the device.

11. The device of claim 10, wherein the pneumatic control system is further configured to purge the device with an airflow to remove fluid and/or contaminants from the device when the impact-generating mechanism is not operating.

12. The device of claim 10, wherein the pneumatic control system is further configured to provide a gas spring between a lower surface of an upper radial extension of the anvil and an upper surface of the pressure wave outlet.

13. The device of claim 10, wherein the plurality of valves are located in a control system housing located above the impact generating mechanism.

14. The device of claim 13, further comprising one or more pneumatic pilot circuits extending between the cylinder and at least one of the valves of the plurality of valves to provide switching between a purge mode and an operational mode by only controlling an air pressure conveyed into the device past a pre-set pressure threshold.

15. The device of claim 14, wherein the plurality of valves includes:

a purge valve to switch between the purge mode and the operational mode;

a vent check valve to provide a path to vent air from the device;

an outlet valve to provide a path to vent air from the device and to prevent ingress of fluids into the device; and a primary control valve to switch between a piston firing mode and a piston return mode.

16. The device of claim 13, further comprising a filter housing located between the control system housing and the connector, the filter housing provided to filter air entering the device via the conveyor.

17. The device of claim 10, wherein the plurality of valves includes:

a vent check valve to provide a path to vent air from the device;

an outlet valve to provide a path to vent air from the device and to prevent ingress of fluids into the device;

a primary control valve to switch between a piston firing mode and a piston return mode; and a pair of solenoid-actuated spool valves under electronic control to actuate the outlet valve and the primary control valve.

18. A system for generating downhole pressure waves, the system comprising:

the device of claim 1 wherein the connector is connected to the conveyor, wherein the conveyor is a coiled tubing conveyor; and a pressure-controllable air supply unit for conveying pressurized air to the device via the coiled tubing, wherein the device is configured to switch between a low-pressure purge mode and a cycling operating sequence when the air supply unit is controlled to provide an air pressure in the device which is above a pre-determined threshold pressure.

19. A process for cleaning plugged perforations in a well, the process comprising:

conveying the device of claim 1 into the well and positioning the device adjacent to a set of casing perforations; and operating the device to generate a series of impacts of the piston on the anvil, thereby generating pressure waves which propagate through the openings and horizontally into the fluid, the pressure waves subsequently impacting and dislodging material plugging the perforations, thereby cleaning the perforations and improving production of hydrocarbons therefrom.

* * * * *